US009303413B2

(12) United States Patent
Koenig, Jr. et al.

(10) Patent No.: US 9,303,413 B2
(45) Date of Patent: Apr. 5, 2016

(54) WALL TRIMMING ELEMENT WITH CORNER PROTECTOR

(71) Applicant: TRIM-TEX, INC., Lincolnwood, IL (US)

(72) Inventors: Joseph M. Koenig, Jr., Glenview, IL (US); Mark Budzik, Des Plaines, IL (US); Adam Jaworecki, Arlington Heights, IL (US); Noe Perez, Naperville, IL (US)

(73) Assignee: TRIM-TEX, INC., Lincolnwood, IL (US)

( * ) Notice: Subject to any disclaimer, the term of this patent is extended or adjusted under 35 U.S.C. 154(b) by 0 days.

(21) Appl. No.: 14/204,323

(22) Filed: Mar. 11, 2014

(65) Prior Publication Data

US 2015/0259929 A1 Sep. 17, 2015

(51) Int. Cl.
*E04F 19/02* (2006.01)
*E04F 13/06* (2006.01)

(52) U.S. Cl.
CPC ..... *E04F 19/022* (2013.01); *E04F 19/028* (2013.01); *E04F 2013/063* (2013.01)

(58) Field of Classification Search
CPC ... E04F 13/06; E04F 13/068; E04F 2013/063; E04F 19/022; E04F 19/028
USPC ..... 52/287.1, 288.1, 254, 255, 256, 417, 52/211, 716.1
See application file for complete search history.

(56) References Cited

U.S. PATENT DOCUMENTS

| | | | | | |
|---|---|---|---|---|---|
| 2,904,856 | A | * | 9/1959 | Robinson | 52/255 |
| 3,712,003 | A | * | 1/1973 | Hallock et al. | 52/254 |
| 3,717,968 | A | * | 2/1973 | Olsen et al. | 52/288.1 |
| 4,104,839 | A | * | 8/1978 | Balzer et al. | 52/288.1 |
| 4,161,853 | A | * | 7/1979 | Weiss et al. | 52/288.1 |
| 4,189,885 | A | * | 2/1980 | Fritz | 52/287.1 |
| 4,430,833 | A | * | 2/1984 | Balzer et al. | 52/255 |
| 4,621,471 | A | * | 11/1986 | Kuhr et al. | 52/288.1 |
| 4,638,606 | A | * | 1/1987 | Wendt | 52/36.6 |
| 4,689,930 | A | * | 9/1987 | Menchetti | 52/277 |
| 4,706,426 | A | * | 11/1987 | Rumsey | 52/232 |
| 4,903,449 | A | * | 2/1990 | Ellingson, Jr. | 52/288.1 |
| 5,045,374 | A | * | 9/1991 | Tucker | 428/83 |
| 5,131,198 | A | * | 7/1992 | Ritchie et al. | 52/287.1 |
| 5,243,797 | A | * | 9/1993 | Koenig, Jr. | 52/254 |
| 5,313,755 | A | * | 5/1994 | Koenig, Jr. | 52/255 |
| 5,740,642 | A | * | 4/1998 | Koenig et al. | 52/255 |
| 5,752,353 | A | * | 5/1998 | Koenig et al. | 52/255 |
| 5,806,253 | A | * | 9/1998 | Nelson | 52/179 |
| 5,813,179 | A | * | 9/1998 | Koenig et al. | 52/255 |
| D412,673 | S | * | 8/1999 | Koenig et al. | D10/64 |
| 6,073,406 | A | * | 6/2000 | Kearney | 52/287.1 |

(Continued)

*Primary Examiner* — James Ference
(74) *Attorney, Agent, or Firm* — Levenfeld Pearlstein LLC

(57) ABSTRACT

A wall trimming element for positioning at an angled section of a wall includes a base portion and a bead. The base portion includes a first flange, a second flange, and a mounting portion positioned between and connecting the first flange and the second flange. The mounting portion includes a longitudinally extending first bend forming a first segment at one side of the first bend and a second segment at another side of the first bend. The first segment is angled relative to the second segment. The mounting portion also includes a first ridge and a second ridge, spaced from the first ridge. The bead is positioned on the mounting portion between the first ridge and the second ridge. The bead includes a second bend that is configured to be positioned over the first bend of the mounting portion.

18 Claims, 5 Drawing Sheets

(56) References Cited

U.S. PATENT DOCUMENTS

| | | | | |
|---|---|---|---|---|
| 6,119,420 | A * | 9/2000 | Koenig et al. | 52/255 |
| 6,212,836 | B1 * | 4/2001 | Larson | 52/287.1 |
| 6,219,980 | B1 * | 4/2001 | Peck, Jr. | 52/288.1 |
| 6,295,776 | B1 * | 10/2001 | Kunz et al. | 52/255 |
| 6,311,442 | B1 * | 11/2001 | Watanabe | 52/282.3 |
| 6,354,049 | B1 * | 3/2002 | Bennett | 52/287.1 |
| 6,360,503 | B1 * | 3/2002 | Koenig, Jr. | 52/287.1 |
| 6,363,673 | B1 * | 4/2002 | Robertson | 52/255 |
| 6,427,418 | B1 * | 8/2002 | Zell | 52/745.05 |
| 6,539,680 | B2 * | 4/2003 | Kunz et al. | 52/256 |
| 6,647,679 | B2 * | 11/2003 | Belleau | 52/254 |
| 6,691,476 | B1 * | 2/2004 | Kunz | 52/287.1 |
| D489,832 | S * | 5/2004 | Koenig et al. | D25/136 |
| 6,779,313 | B2 * | 8/2004 | Smythe, Jr. | 52/255 |
| 7,013,610 | B2 * | 3/2006 | Kunz | 52/255 |
| 7,214,434 | B2 * | 5/2007 | Dalgleish et al. | 428/537.5 |
| 7,383,668 | B1 * | 6/2008 | Kunz | 52/255 |
| D601,274 | S * | 9/2009 | Koenig, Jr. | D25/164 |
| 7,788,865 | B2 | 9/2010 | Koenig, Jr. et al. | |
| 8,046,963 | B2 * | 11/2011 | Wambaugh et al. | 52/287.1 |
| 2002/0005023 | A1 * | 1/2002 | Ford | 52/514 |
| 2002/0083665 | A1 * | 7/2002 | Razetto | 52/288.1 |
| 2002/0134035 | A1 * | 9/2002 | Koenig et al. | 52/272 |
| 2003/0224708 | A1 * | 12/2003 | Koenig, Jr. | 451/461 |
| 2004/0093816 | A1 * | 5/2004 | Smythe, Jr. | 52/255 |
| 2004/0163340 | A1 * | 8/2004 | Harel | 52/287.1 |
| 2005/0172571 | A1 * | 8/2005 | Koenig et al. | 52/718.01 |
| 2005/0193664 | A1 * | 9/2005 | Koenig et al. | 52/287.1 |
| 2006/0059809 | A1 * | 3/2006 | Smythe, Jr. | 52/255 |
| 2006/0150570 | A1 * | 7/2006 | Fitzpatrick et al. | 52/720.1 |
| 2006/0272237 | A1 * | 12/2006 | Koenig et al. | 52/211 |
| 2008/0066403 | A1 * | 3/2008 | Koenig et al. | 52/255 |
| 2009/0205279 | A1 * | 8/2009 | Koenig et al. | 52/417 |
| 2012/0174509 | A1 * | 7/2012 | Dhinjan | 52/255 |

* cited by examiner

WALL TRIMMING ELEMENT WITH CORNER PROTECTOR

BACKGROUND

The following description relates to a wall trimming element, and in particular, a wall trimming element having a corner protector positioned around a joint of adjacent wall segments or a corner of a wall to cover the joint or corner.

In commercial settings, corners of walls or joints of adjacent wall segments may be subject to accelerated wear. For example, in hospitals, hotels, restaurants, stores, offices or other public areas with increased foot or equipment traffic, a corner or joint of a wall may be subject to increased levels of contact from persons or equipment maneuvering around the corner or joint. In one example, a hotel lobby or hallway may include foot traffic as well as luggage and bell cart traffic. The persons, luggage or carts may contact the wall corners or joints, for example, as they maneuver through a hallway or enter another room.

Increased contact with the wall corners or corner joints may cause premature wear on the wall. For example, contact between a person, luggage, cart or other moving object against the corner of the wall may result in scrapes, scratches and/or gouges in a finishing layer on the corner of the wall. In other situations, the contact may be forceful enough to damage the wall itself, by removing wall material or damaging a wall covering such as wallpaper. This increased wear or damage to the walls may be aesthetically displeasing. Efforts to maintain or repair worn or damaged portions of the wall may be time consuming and costly, and provide only temporary solutions. In addition, contact between persons or objects, such as luggage, carts or equipment with exposed wall corners may lead to injury to the person or damage the object.

Corner protectors have been developed to be fitted around corners of walls. Corner protectors are typically made of a plastic, rubber, polymer or other wear resistant material. The corner protectors extend around the corner so that the corner is not directly exposed to contact from persons or objects. The corner protectors may be formed of a thickness sufficient to protect the corner or joint of the wall from wear or damage resulting from contact with persons or objects. Likewise, the corner protectors may protect the persons or objects from injury or damage resulting from contact with the corner of the wall.

One type of corner protector is secured, for example, by adhesive, nails, or screws, over the corner of a finished wall. As a result, the corner protectors project outward from the wall a distance corresponding to the thickness of the bead. That is, traditional corner protectors are not flush with the wall to which they are secured. As result, the corner protectors, at their ends projecting from the wall, are susceptible to catching onto persons or objects moving past the beads. This contact may cause the corner protector to separate from the wall, thereby damaging the wall and reducing the effectiveness of the corner protector. Moreover, such corner protectors may not be aesthetically pleasing because of how far they extend out from the corner.

Other corner protectors are known that are of a two-piece design. A first piece or mount mounts to the corner by, for example, mechanical fasteners, adhesive or the like. A second piece or cover is secured to the mount. The cover can be permanent or replaceable. However, these two-piece deigns suffer from the same or even exaggerated drawbacks in that they extend even further from the corner than the one-piece design.

Accordingly, it is desirable to provide a wall trimming element for placement around a corner of a wall or joint of adjacent wall segments that is flush or near flush with the surrounding wall. Desirably, such a corner protector is integrated into the wall/corner structure and has a low profile relative to the wall adjacent to it. More desirably still, such a bead provide provides protection from inadvertent contact with the corner, is aesthetically pleasing and can be incorporated into or incorporate wall finishes, including paint and/or wall coverings such as wallpaper.

SUMMARY

According to one embodiment, there is provided a wall trimming element for positioning at an angled section of wall, the wall trimming element including a base portion and a bead. The base portion includes a first flange and a second flange, each of the first flange and the second flange have a flange interior surface and a flange exterior surface. The base portion also includes a mounting portion positioned between and connecting the first flange and the second flange. The mounting portion includes a mounting portion interior surface and a mounting portion exterior surface and a longitudinally extending first bend. A first segment of the mounting portion is formed at one side of the first bend and a second segment of the mounting portion is formed at another side of the first bend. The first segment is angled relative to the second segment by a first angle at the first bend.

The base portion can further include a first ridge projecting from the mounting portion exterior surface and a second ridge, spaced from the first ridge, projecting from the mounting portion exterior surface. In such an embodiment, the bead is positioned on the mounting portion between the first ridge and the second ridge. The bead includes a second bend corresponding to the first bend of the mounting portion such that the second bend of the bead is positioned over the first bend of the mounting portion.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
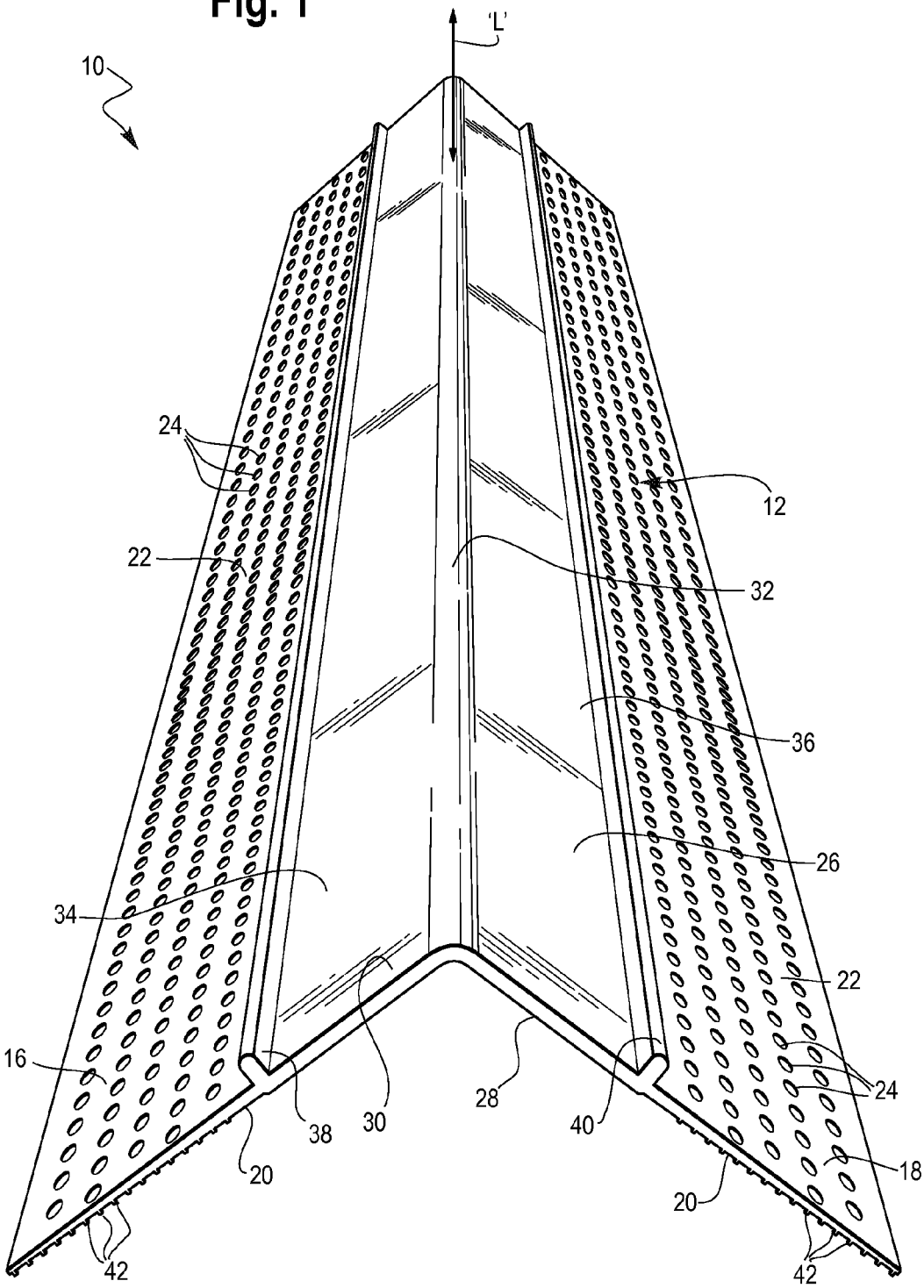
FIG. 1 is a top perspective view of a base portion of a wall trimming element according to one embodiment.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is a top perspective view of an embodiment of a wall trimming element 10. Referring to FIG. 1, the wall trimming element 10 may extend in a longitudinal direction 'L'. The wall trimming element 10 may generally be angled to fit around an angled portion of a wall, such as a corner or a joint of adjacent wall segments. In one embodiment, the wall trimming element 10 includes a base portion 12 and a bead 14 (see FIGS. 3-5). The base portion 12 includes a first flange 16 and a second flange 18. Each of the first flange 16 and the second flange 18 has a flange interior surface 20 and a flange exterior surface 22. A plurality of openings 24 may be formed in, and extend through, each of the first flange 16 and the second flange 18 from the flange interior surface 20 to the flange exterior surface 22.

The base portion 12 also includes a mounting portion 26 positioned between and connecting the first flange 16 and the second flange 18. The mounting portion 26 includes a mounting portion interior surface 28 and a mounting portion exterior surface 30. The mounting portion interior surface 28 and/or the mounting portion exterior surface 30 may formed as a generally smooth, continuous surface, i.e., without openings or other surface features, such as ribs. The mounting portion 26 further includes a first bend 32 extending in the longitudinal direction 'L'. The first bend 32 divides the mounting portion 26 into a first segment 34 at one side of the first bend 32 and a second segment 36 at another, opposite, side of the first bend 32. The first bend 32 may be formed as an angled or curved section. In some embodiments, the first bend 32 may be rounded or curved at both the mounting portion interior surface 28 and the mounting portion exterior surface 30. Alternatively, the first bend 32 may be rounded or curved at one of the interior or exterior surfaces 28, 30 of the mounting portion 26, and angled at the other of the interior or exterior surface 28, 30 of the mounting portion 26.

The base portion 12 can further include a first ridge 38 and a second ridge 40. The first ridge 38 and the second ridge 40 project outwardly from the mounting portion exterior surface 30. In one non-limiting embodiment, the first ridge 38 and the second ridge 40 may project outwardly from the mounting portion exterior surface 30 at, for example, approximately 90 degrees relative thereto. The first ridge 38 and the second ridge 40 may also extend along the mounting portion exterior surface 30 generally in the longitudinal direction 'L', parallel to one another. Referring to the example in FIG. 1, the first ridge 38 may be positioned on and project from the first segment 34 and the second ridge 40 may be positioned on and project from the second segment 36. In one embodiment, the first ridge 38 may be positioned at a boundary of the mounting portion 26 and the first flange 16. Similarly, the second ridge 40 may be positioned at a boundary of the mounting portion 26 and the second flange 18.

Figure 2:
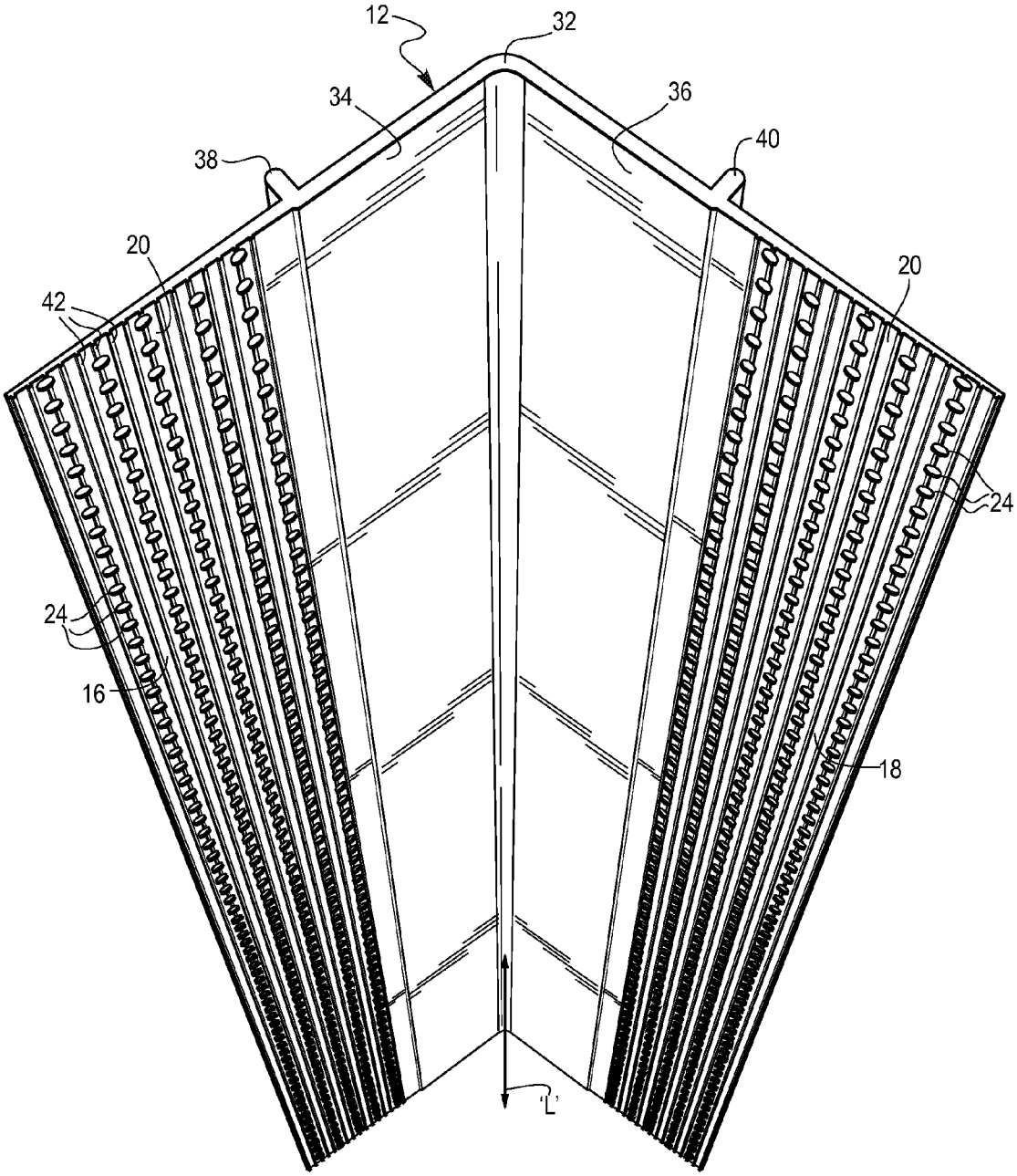
FIG. 2 is a bottom perspective view of the base portion of the wall trimming element.

FIG. 2 is a bottom perspective view of the base portion 12 according to one embodiment. Referring to FIGS. 1 and 2, the flange interior surface 20 of the first flange 16 and second flange 18 may include a first plurality of ribs 42 protecting therefrom and extending in the longitudinal direction 'L'. The ribs 42 may extend parallel to another in some embodiments. In addition, at least some of the ribs 42 may intersect with the openings 24. In some embodiments, the flange exterior surface 22 may be formed with a second plurality of ribs 42. However, it is understood that the present disclosure is not limited to the configurations of the first plurality ribs 42 and second plurality of ribs 42 described above. For example, the first plurality ribs 42 and the second plurality of ribs 42 may be formed linearly or non-linearly and project from a respective flange surface at a right angle or non-right angle. Additional examples of configurations for the first plurality of ribs 42 and second plurality of ribs 42 envisioned by the present disclosure are shown in Koenig, Jr., U.S. Pat. No. 7,788,865, which is incorporated herein by reference, in its entirety.

The base portion 12 may be formed as a unitary, one-piece, monolithic structure. That is, the first flange 16, the second flange 18, the mounting portion 26, the first ridge 38 and the second ridge 40 may be formed as a single piece. The base portion 12 may be made from, for example, a plastic, polymer or rubber material, or other similar, wear resistant material having suitable characteristics, such as resiliency, flexibility, rigidity and the like.

Figure 3:
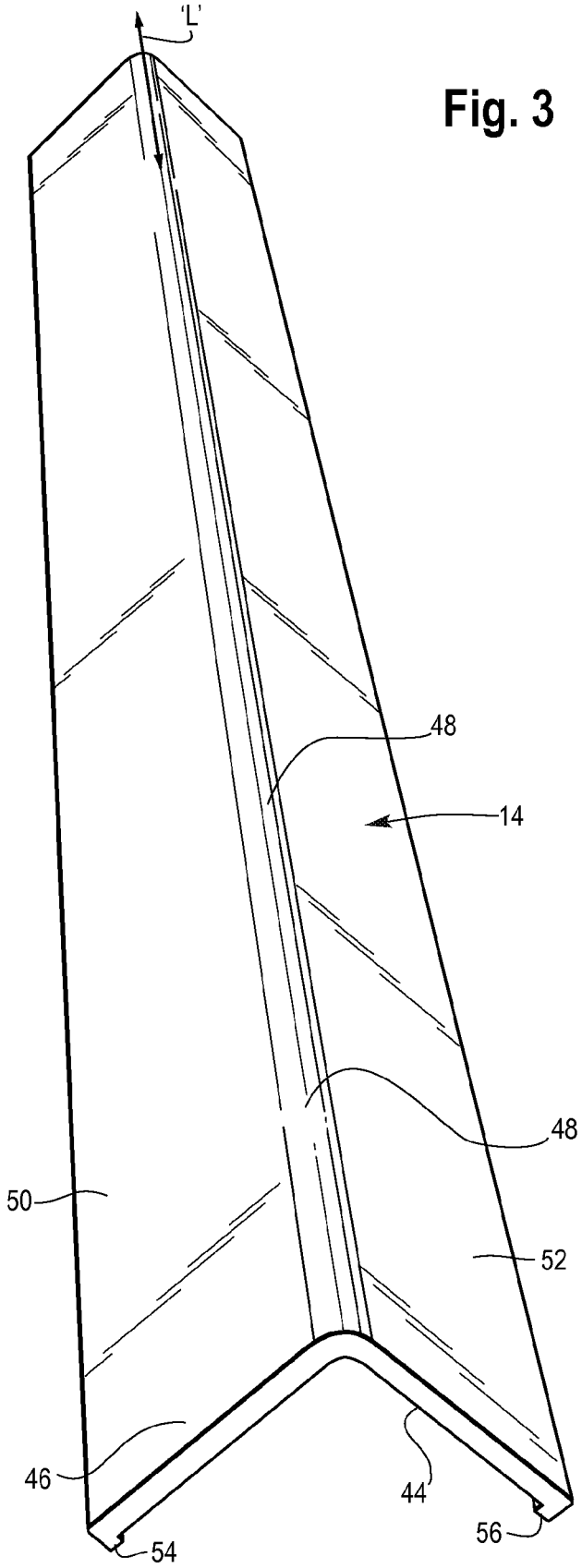
FIG. 3 is top perspective view of a bead of the wall trimming element according to an embodiment.

FIG. 3 is a perspective view of bead 14 according to one embodiment. The bead 14 is configured to be received on and secured to the base portion 12 at the mounting portion 26 and may be positioned between the first ridge 38 and the second ridge 40, if used, as described below with reference to FIGS. 4 and 5. The bead 14 includes a bead interior surface 44 and a bead exterior surface 46. The bead 14 also includes a second bend 48 extending in the longitudinal direction 'L'. The second bend 48 may be formed as either an angled or a curved section. In some embodiments, the second bend 48 may be angled at the bead interior surface 44 and rounded or curved at the bead exterior surface 46, or vice versa. Alternatively, the second bend 48 may be angled at both the bead interior surface 44 and bead exterior surface 46, or curved or rounded at both the bead interior surface 44 and bead exterior surface 46. A first bead segment 50 is formed at one side of the second bend 48 and a second bead segment 52 is formed at another side of the second bend 48.

The bead 14 may further include a first leg 54 and a second leg 56. The first leg 54 and the second leg 56 may project from the bead interior surface 44 and extend in the longitudinal direction 'L' as described further below. The bead 14 may be formed of a durable material, including, but not limited to, plastics, polymers, rubbers or other similar materials with characteristics similar to those of the base portion 12. In one embodiment the bead 14 may be made from polyvinyl chloride (PVC).

Figure 4:
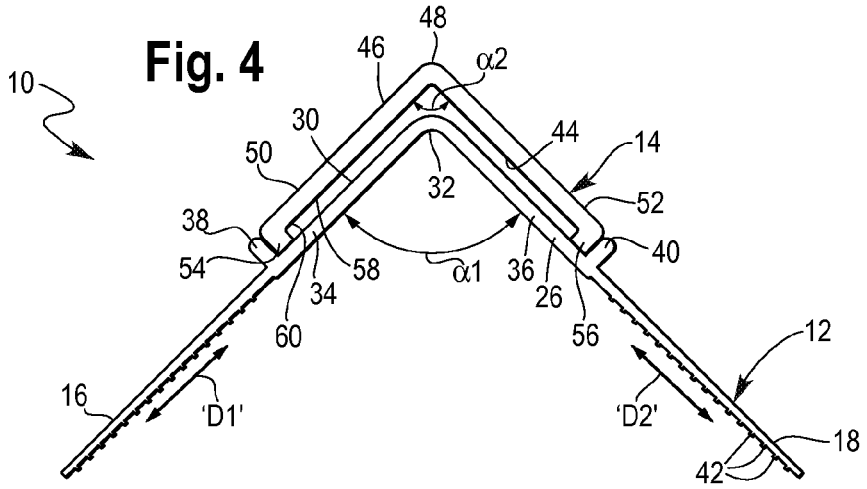
FIG. 4 is a cross-sectional view of the wall trimming element in an assembled condition.

FIG. 4 is a cross-sectional view of the assembled wall trimming element 10 according to an embodiment. Referring to the example in FIG. 4, the first leg 54 and second leg 56 may be positioned on the first bead segment 50 and second bead segment 52, respectively. In one example, the first and second legs 54, 56 may be positioned at respective free ends of the first and second bead segments 50, 52.

As described above, the bead 14 may be received at the mounting portion 26 of the base portion 12. In one embodiment, the first leg 54 and the second leg 56 contact the mounting portion 26 adjacent to the first ridge 38 and second ridge 40, respectively. The first and second legs 54, 56 may define a space 58 between the bead interior surface 44 and the mounting portion exterior surface 30. An adhesive 60 may be received within the space 58 to secure the bead 14 to the mounting portion 26 of the base portion 12. The space 58 may also allow for energy absorption between the bead 14 and the mounting portion 26 in the event a person or object comes into contact with the bead 14. The bead 14 may be configured so as to be removable and replaceable on the base portion 12. Accordingly, a suitable adhesive is used to secure the bead 14 to the base portion 12.

In addition, the first and second legs 54, 56 may project from the bead interior surface 44 to a height where the bead exterior surface 46 is substantially flush with a free end of the first ridge 38 and a free end of the second ridge 40 when the bead 14 is secured to the mounting portion 26. That is, for example, with height measured in a direction normal to a surface of the mounting portion 26, a height of the bead exterior surface 46 relative to the mounting portion 26 may be substantially the same as respective heights of a free end of the first ridge 38 and a free end of the second ridge 40 relative to the mounting portion 26. Alternatively, the first and second legs 54, 56 may be dimensioned so that the bead exterior surface 46 projects beyond, i.e., extends further outward from mounting portion exterior surface 30, than the first and second ridges 38, 40. That is, for example, with height measured in a direction normal to a surface of the mounting portion 26, a height of the bead exterior surface 46 relative to the mounting portion 26 may be greater than the respective heights of the free end of the first ridge 38 and the free end of the second ridge 40 relative to the mounting portion 26.

With further reference to FIG. 4, the first segment 34 of the mounting portion 26 extends in a first direction D1 and the second segment 36 of the mounting portion extends in a second direction D2. The first segment 34 and second segment 36 may be angled relative to one another at a first angle al at the first bend 32. The first angle α1 at which the first segment 34 and the second segment 36 are oriented relative to one another may correspond to an angle of a corner or joint of wall where the wall trimming element 10 is to be secured. In one non-limiting example, the first angle α1 may be, for example, between 70 degrees and 150 degrees. In some embodiments, the angle al may be approximately 90 degrees. It is understood that although this disclosure refers to a first angle α1 at the first bend 32, the first bend 32 is not necessarily angular. That is, as described above, the first bend 32 may be curved or rounded, or angular. The first angle α1, as described herein, may refer to an angle of an intersection of the first and second segments 34, 36 at the first bend 32, where the first bend 32 is angular. Alternatively, where the first bend 32 is curved or rounded, the first angle al may refer to an angle between the first direction D1 and the second direction D2 in which the first segment 34 and the second segment 36 extend, respectively.

In one embodiment, the first flange 16 and second flange 18 may be formed integrally with the first segment 34 and second segment 36, respectively. The first flange 16 may be coplanar with the first segment 34 and the second flange 18 may be coplanar with the second segment 36. Accordingly, the first flange 16 and the second flange 18 may also extend in the first direction D1 and second direction D2, respectively. It is understood, however, that the present disclosure is not limited to this configuration. For example, the first and second flanges 16, 18 may be angled relative to the first and second segments 34, 36 of the mounting portion 26 such that the first and second flanges 16, 18 extend in directions other than the first and second directions D1, D2.

Still referring to FIG. 4, the second bend 48 of the bead 14 may generally correspond to the first bend 32 of the mounting portion. That is, a second angle α2, at the second bend 48, formed between the first bead segment 50 and second bead segment 52, may be substantially the same as the first angle α1 formed by the first segment 34 and second segment 36 of the mounting portion 26. Thus, in one embodiment, the second angle α2 may be formed between approximately 70 degrees and 150 degrees. In another example, the second angle α2 may be formed at approximately 90 degrees. In some embodiments, the first angle α1 and second angle α2 are substantially the same as an angle formed by the corner or joint of the wall over which the wall trimming element 10 may be secured.

It is understood that although this disclosure refers to a second angle α2 at the second bend 48, the second bend 48 is not necessarily angular. That is, as described above, the second bend 48 may be curved or rounded, or angular. The second angle α2, as described herein, may refer to an angle of an intersection of the first and second bead segments 50, 52 at the second bend 48, where the second bend 48 is angular. Alternatively, where the second bend 48 is curved or rounded, the second angle α2 may refer to an angle between an intersection of a direction in which the first bead segment 50 extends, and another direction in which the second bead segment 52 extends.

In some embodiments, the first bead segment 50 and second bead segment 52 may extend substantially parallel to the first segment 34 and second segment 36, respectively, of the mounting portion 26. Accordingly, the bead 14 may be positioned on the mounting portion 26 with the second bend 48 positioned over the first bend 32. It is understood that the present disclosure is not limited to this configuration. For example, the respective first and second angles α1, α2 formed at the first bend 32 and second bend 48 may differ from one another so long as the bead 14 may be positioned over the mounting portion exterior surface 30.

Figure 5:
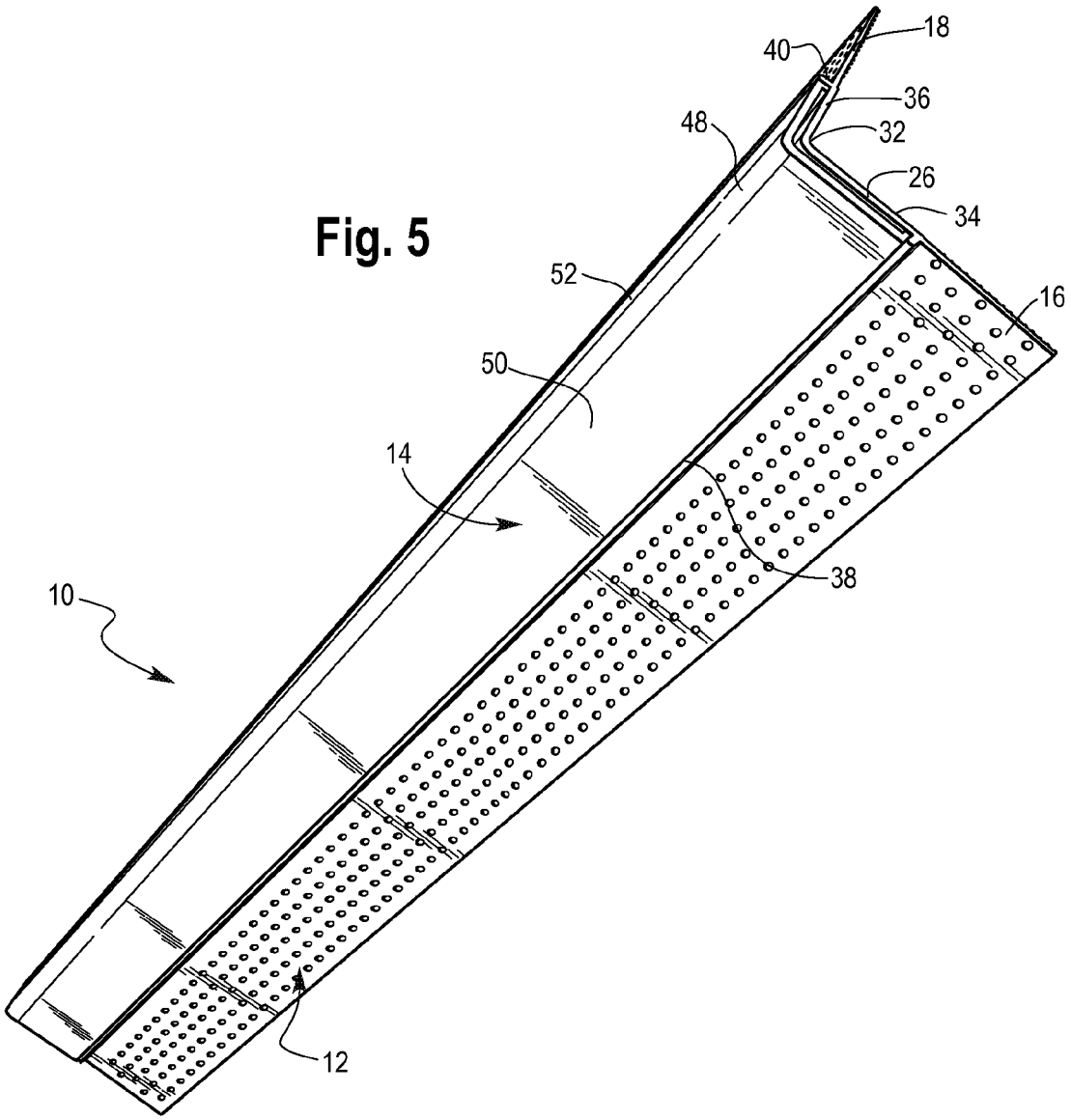
FIG. 5 is a perspective view of the wall trimming element in the assembled condition.
Figure 6:
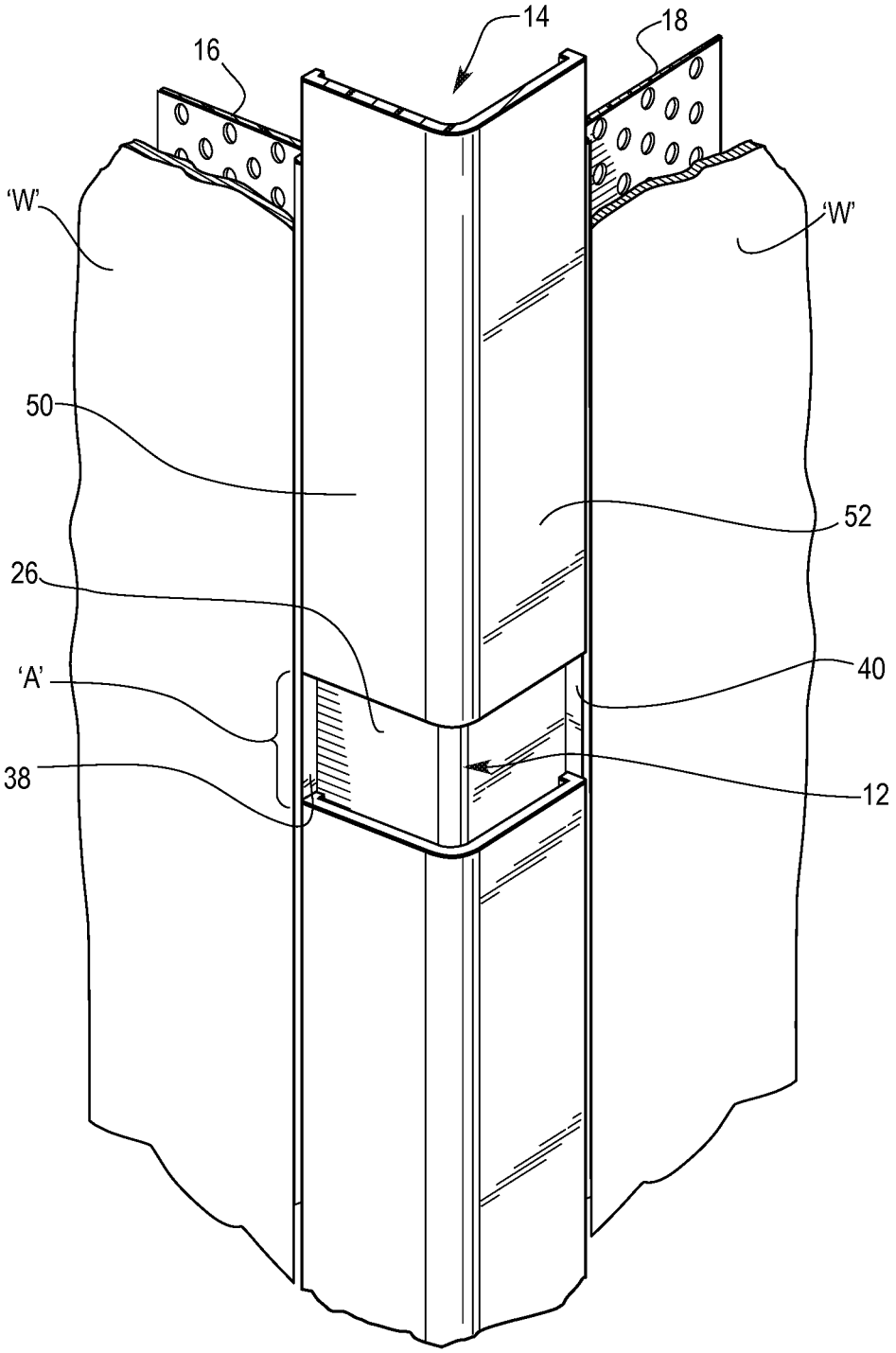
FIG. 6 illustrates the wall trimming element installed on a corner or joint of a wall according to an embodiment.

FIG. 5 is a perspective view of the wall trimming element 10 in the assembled condition, i.e., with the bead 14 secured to the base portion 12. FIG. 6 illustrates the wall trimming element 10 installed on a corner or joint of a wall. FIG. 6 includes a cutaway section 'A' for illustrative purposes, showing the base portion 12 positioned under the bead 14, along with the first ridge 38, with the wall trimming element installed on the wall corner.

Referring to FIGS. 5 and 6, the wall trimming element 10 is configured to fit over a corner or other angled intersection of a wall 'W'. For example, the wall trimming element 10 may be positioned over an intersection of two adjacent segments of drywall forming a corner or joint. The base portion 12 may be positioned relative to the drywall so that the flange interior surface 20 and mounting portion interior surface 28 face the drywall and may contact the drywall directly. A joint compound or mud may be applied to the drywall to secure wall trimming element 10 thereto. For example, the joint compound may be received between the plurality ribs 42 on the flange interior surface 20 of the first flange 16 and second flange 18. In addition, the joint compound may be received through the openings 24 at the flange interior surface 20 and extend through the openings 24 to the flange exterior surface 22. Accordingly, the joint compound may form a positive interlock with the wall trimming element 10 to secure the wall trimming element 10 to the drywall.

FIG. 6 includes a cutaway section 'A' in the bead 14 for illustrative purposes, to show a portion of the base portion 12 positioned under the bead 14. The first ridge 38 is also shown in the cutaway section 'A' with the wall trimming element 10 installed on the wall corner. Referring further to FIG. 6, the joint compound may extend through the openings 24 so that it is applied over the first flange 16 and the second flange 18. The joint compound may abut the first ridge 38 and the second ridge 40 and may be leveled off so that the joint compound on the flange exterior surface 22, the free ends of the first and second ridges 38, 40 and the bead exterior surface 46 present a substantially flush outer surface.

In some embodiments, the joint compound may be applied and leveled off over, i.e., covering, the first and second ridges 38, 40 to be flush with the bead exterior surface 46. Further, in some embodiment, the joint compound may be leveled off so that a portion of the bead exterior surface 46 extends beyond the joint compound. A finishing layer, such as paint or wall paper may be applied over the joint compound and may be flush with the bead exterior surface 46. With the wall trimming element installed on the wall corner, as shown in FIG. 6, the first and second flanges 16, 18 may be covered by the joint compound, finishing layer, or both.

In the examples above, the wall trimming element 10 may be secured at a corner of an underlying wall, for example, at an angled intersection of two segments of drywall to form a covered wall joint. The base portion 12 may act as a support and mounting base for the bead 14. Accordingly, in high traffic areas, such as in hallways, lobbies or other rooms in public areas, the bead 14 may protect the corner of the underlying wall, joint compound or finishing layer from damage and/or wear caused by contact from persons or objects by preventing or limiting direct contact between the wall and the persons or objects. Further, the bead 14 may prevent injury or damage to persons or objects coming into contact with the covered wall joint by shielding the corner of the underlying wall from contacting the person or object.

In the embodiments described above and shown in the figures, the wall trimming element is configured to be secured on corner of wall that is angled approximately 90 degrees. However, it is understood that the wall trimming element 10 may be manufactured with different angles formed at the first and second bends 32, 48, i.e., different first and second angles $\alpha 1$, $\alpha 2$, for installation on corners or joints having different angular dimensions. In addition, the mounting portion 26 of the base and bead 14 may be formed as generally curved sections for securing to curved wall sections.

Additionally, in the examples, the terminology "interior" and "exterior" are used described various surfaces of the first and second flanges 16, 18, the mounting portion 26 and the bead 14, for example. It is understood that in the examples above, an "interior" side or surface is a surface that generally faces the wall or joint on which the wall trimming element is installed. An "exterior" side or surface, in the examples above, faces away from the wall or joint on which the wall trimming element is installed. Further, the examples above refer to the wall trimming element 10 being used at a corner formed by an intersection of two segments of drywall. It is understood, however, that the wall trimming element of the present disclosure is not limited for use in drywall applications, and may be used with, i.e., secured to, walls made of different materials.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A wall trimming element for positioning at an angled section of a wall, the wall trimming element comprising:

a base portion comprising:

a first flange and a second flange, each of the first flange and the second flange having a flange interior surface and a flange exterior surface;

a mounting portion positioned between and connecting the first flange and the second flange, the mounting portion having a mounting portion interior surface and a mounting portion exterior surface and a longitudinally extending first bend forming a first segment of the mounting portion at one side of the first bend and a second segment of the mounting portion at another side of the first bend, the first segment angled relative to the second segment by a first angle at the first bend; and a first ridge at a boundary of the first flange and the first segment projecting outwardly relative to the first flange and the first segment and a second ridge at a boundary of the second flange and the second segment projecting outwardly relative to the second flange and the second segment; and a bead positioned on the mounting portion between the first ridge and the second ridge, the bead including a second bend corresponding to the first bend of the mounting portion such that the second bend of the bead is positioned over the first bend of the mounting portion, wherein the bead includes a bead interior surface and bead exterior surface, and a first leg extends from the bead interior surface at one end of the bead and a second leg extends from the bead interior surface at an opposite end of the bead, the bead interior surface, the mounting portion exterior surface, the first leg and the second leg forming a periphery around a single space.

2. The wall trimming element of claim 1 wherein the first ridge and the second ridge project from the mounting portion exterior surface.

3. The wall trimming element of claim 1, wherein the first segment of the mounting portion is connected to the first flange and the second segment of the mounting portion. is connected to the second flange.

4. The wall trimming element of claim 1, wherein the first segment is integrally connected to the first flange, and the first segment and first flange extend in a first direction, and the second segment is integrally connected to the second flange, and the second segment and second flange extend in a second direction.

5. The wall trimming element of claim 1, wherein the first segment is angled relative to the second segment between 70 degrees and 150 degrees.

6. The wail trimming of element of claim 5, wherein the first segment is angled relative the second segment 90 degrees.

7. The wall trimming element of claim 1, wherein the first bend is an angle.

8. The wall trimming element of claim 1, wherein the first bend is a curved section.

9. The wall trimming element of claim 1, wherein the first ridge extends from the first segment and the second ridge extends from the second segment.

10. The wall trimming element of claim 1, wherein the first flange and the second flange include a plurality of openings extending through a thickness of each flange from the flange interior side to the flange exterior side.

11. The wall trimming element of claim 1, wherein the flange interior surface of the first flange and the second flange includes a first plurality of ribs projecting therefrom.

12. The wait trimming element of claim 1, wherein the bead exterior surface is flush with a free end of the first ridge and a free end of the second ridge.

13. The wall trimming element of claim 1, wherein a height of the bead exterior surface from the mounting portion is greater than a height of the free end of the first ridge and a height of the free end of the second ridge from the mounting portion.

14. The wall trimming element of claim 1, wherein the bead is secured to the mounting portion with an adhesive received in the space.

15. The wall trimming element of claim 1, wherein the second bend is rounded at the bead exterior surface.

16. The wall trimming element of claim 1 wherein a first bead segment is formed at one side of the second bend and a second bead segment is formed at another side of the second bend, wherein the first bead segment is generally parallel to the first segment of the mounting portion and the second bead segment is generally parallel to the second segment of the mounting portion.

17. The wall trimming element of claim 1, wherein the first flange is coplanar with the first segment and the second flange is coplanar with the second segment.

18. A wall trimming element for positioning at an angled. section of a wall, the wall trimming element comprising a one-piece base portion and a bead, the one-piece base portion comprising:

a first flange and a second flange, each of the first flange and the second flange having a flange interior surface and a flange exterior surface;

a mounting portion positioned between and formed continuously with the first flange and the second flange, the mounting portion having a mounting portion interior surface and a mounting portion exterior surface and a longitudinally extending first bend forming a first segment of the mounting portion at one side of the first bend and a second segment of the mounting portion at another side of the first bend, the first segment angled relative to the second segment by a first angle at the first bend;

a first ridge formed continuously with and defining a boundary between the first segment and the first flange, the first ridge projecting outwardly relative to the first segment and the first flange;

a second ridge formed continuously with and defining a boundary between the second segment and the second flange, the second ridge projecting outwardly relative to the second segment and the second flange; and the bead comprising a longitudinally extending second bend, a first bead segment extending from one side of the second bend and a second bead segment extending from another side of the second bend, wherein the bead is configured to fit over the mounting portion exterior surface and be positioned between the first ridge and the second ridge, wherein the first segment of the mounting portion extends as a first planar surface from the first bend to the first ridge on the mounting portion exterior surface and the second segment of the mounting portion extends as a second planar surface from the first bend to the second ridge on the mounting portion exterior surface.

* * * * *